United States Patent [19]

Chen

[11] Patent Number: 4,922,636

[45] Date of Patent: May 8, 1990

[54] SHOE SPIKE/RECEPTACLE ASSEMBLY

[75] Inventor: York Chen, San Mateo, Calif.

[73] Assignee: Contax Sports Inc., Burlingame, Calif.

[21] Appl. No.: 96,666

[22] Filed: Sep. 15, 1987

[51] Int. Cl.[5] ..... A43C 15/00; A43B 5/00

[52] U.S. Cl. ..... 36/127; 36/134; 36/670

[58] Field of Search ..... 36/134, 127, 128, 67 R, 36/67 A, 67 B, 67 D, 59 R

[56] References Cited

U.S. PATENT DOCUMENTS

| | | | |
|---|---|---|---|
| 2,309,783 | 2/1943 | Park | 36/67 D |
| 2,787,843 | 4/1957 | Phillips | 36/67 D |
| 3,715,817 | 2/1973 | White et al. | 36/67 D |
| 4,240,215 | 12/1980 | Broussard | 36/127 |
| 4,330,950 | 5/1982 | Reddien | 36/67 D |
| 4,587,748 | 5/1986 | Collins | 36/134 |
| 4,651,448 | 3/1987 | Chen | 36/134 |

FOREIGN PATENT DOCUMENTS

| | | | |
|---|---|---|---|
| 736362 | 9/1955 | United Kingdom | 36/67 D |
| 780758 | 8/1957 | United Kingdom | 36/67 D |
| 1151306 | 5/1969 | United Kingdom | 36/67 D |
| 2028102 | 3/1980 | United Kingdom | 36/67 D |
| 2163037 | 2/1986 | United Kingdom | 36/134 |

*Primary Examiner*—Steven N. Meyers
*Attorney, Agent, or Firm*—Irell & Manella

[57] ABSTRACT

An assembly of a golf spike and receptacle assembly for mounting the spike are made to be joined in a nylon connection. This is provided by a receptacle assembly made of nylon and having a receptacle formed in a base portion and an arm extending radially from the base portion. Two forms of arms are provided, one having knobs and the other having an elongate aperture in which the knobs may be selectively received. The distance between receptacles may be varied by varying the position of the knobs in the aperture. A spike is provided having a metal spike member with a head, a flange and an anchor portion. The anchor portion is embedded in a nylon support member which forms a larger flange next to the metal flange and an engagement member having external threads for screwing into a receptacle. The anchor portion may have a circumferential groove, flattened edge, transverse or longitudinal grooves, a bore, or be partially hammered to produce an oval shape with outwardly diverging sides.

5 Claims, 3 Drawing Sheets

SHOE SPIKE/RECEPTACLE ASSEMBLY

FIELD OF THE INVENTION

This invention relates to the field of athletic shoe manufacture. More specifically, it relates to an assembly of a combination metal/synthetic spike and an associated receptacle formed of mutually attachable receptacle members.

BACKGROUND AND SUMMARY OF THE INVENTION

It has long been understood that it is desirable to provide stability to the wearer of athletic shoes designed for use in golf. Because the motion of the player in execution of drives in the course of this game results in instability of footing, footwear has been developed which provides the player improved traction relative to the ground. Ordinarily, this is accomplished by providing, in the soles of shoes designed for golfers, a pattern of metal spikes or cleats which become embedded in the turf, and thus provide the player with a firm footing.

Traditionally, the spikes are secured to a leather, rubber or synthetic shoe sole by means of flat metal plate bearing a series of pronged fasteners or receptacles around its periphery, and a tubular threaded female connector protruding from its center toward the bottom of the shoe. The spike itself is contiguous with a threaded male connector, and is provided with a metal flange containing two holes which permit insertion of a two-pronged key. The two-pronged key, then, is used to turn the flange containing the spike and male connector so as to secure the spike to the receptacle assembly.

As mentioned, receptacles are normally mounted on a flat plate having several receptacles in a desired pattern for a particular shoe size or range of sizes. Recently, these plates have been formed of plastic or nylon in order to substantially reduce the weight of the shoe. In another form two receptacles are mounted on a steel or rubber strap, with several such straps being used to provide the necessary number of receptacles. Alternatively, the receptacles are provided with individual plates or mounting assemblies so that they can be placed in any desired arrangement. However, these tend to be unstable and concentrate the forces applied to each spike on the associated shoe sole so that increased wear results.

Because of the required number of spikes, the metal flange portions add considerable weight to the shoe. Therefore, improvements have been made in the spike assembly by using only a metal frame contiguous with the connector and spike, and embedding the metal frame into a plastic or nylon flange. In this version of the spike assembly, the lighter weight of the plastic or nylon results in a lighter shoe. One design of this modification utilizes a plastic thread on the male connector, as well, but this has proved unsatisfactory due to inadequate strength when used with a metal receptacle. However, when used with a nylon or plastic receptacle, the threads do not tend to become damaged.

A design which has improved on this is one in which a metal spike having a smaller flange and an anchor extension extending from the smaller flange. The anchor extension has a hollow end which is placed through a nylon sleeve having a larger flange seating against the smaller flange. The anchor extension is anchored onto the nylon sleeve by deforming the hollow end after it is passed through the sleeve, thereby capturing the sleeve on the anchor portion. This design also has disadvantages in that it requires the making of the hollow end plus the additional manufacturing step of assembling the sleeve and spike member and then deforming the hollow end of the anchor extension so that the sleeve is captured. Further, this design does not prevent the rotating of the sleeve relative to the spike member, a condition which does not affect the utility of the spike but which can be considered by spike users as an indication of poor quality.

The present invention overcomes these deficiencies. In particular it provides a spike and receptacle assembly which is light weight and easy to manufacture. The spike of the invention provides a metal spike member with an anchor portion completely embedded in a nylon or plastic threaded engagement portion formed with a larger flange portion. By embedding the anchor portion in the threaded nylon engagement portion, the engagement portion is formed in a single step. It is secured by forming in the anchor portion features which prevent the removal and/or rotation of the anchor portion relative to the spike member.

The receptacle assembly of the present invention provides receptacles preferably formed of nylon or plastic on a unitary arm which is adjustably joinable with another similar receptacle member. These assemblies can be assembled with the receptacles in a large variety of possible relative orientations. Thus, the single assembly can accommodate a large variety of shoe sizes and provides an extended base for supporting the spikes.

These and other features and advantages of the present invention will be more clearly understood from the drawings and the following detailed description of the preferred embodiments.

DETAILED DESCRIPTION OF THE PREFERRED EMBODIMENT

Figure 1:
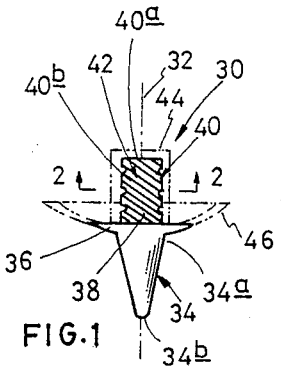
FIG. 1 is a side view of spike member of a first preferred embodiment of a shoe spike made according to the present invention.

Referring initially to FIGS. 1-4, a first preferred embodiment of a shoe spike 28 made according to the present invention is shown. The embodiments illustrated in FIGS. 1-15 are illustrative. Any design within the scope of the claims, although not specifically shown in the drawings, is to be considered a part of the invention.

Figure 2:
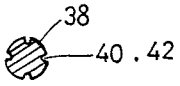
FIG. 2 is a cross section of the spike member of FIG. 1 taken along line 2—2.

FIGS. 1 and 2 show in solid lines a metal spike member 30 forming part of spike 28, extending along a longitudinal axis 32 and comprising a ground-engaging head portion 34 having a base 34*a* and a tip 34*b*. Girdling member 30 adjacent base 34*a* is what is referred to as a smaller flange portion 36. This portion is slightly convex from the direction of portion 34. Extending from base 34*a* opposite from tip 34*b* is an anchor portion 38 also extending along axis 32. Anchor portion 38 is generally cylindrical in shape except for a plurality of spiral grooves 40 and 42. Grooves 42 spiral toward the distal end of the anchor portion in a clockwise direction when viewed from the distal end or as viewed in FIG. 2. Grooves 42 are transverse to grooves 40 and spiral in a counterclockwise direction. Grooves 40 and 42, respectively, are formed by a plurality of parallel grooves, such as grooves 40*a* and 40*b*.

Figure 3:
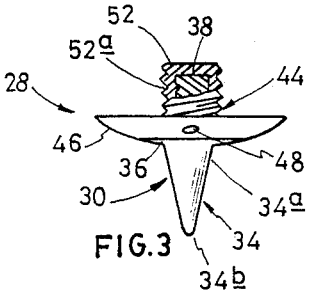
FIG. 3 is a partially cross section side view of a shoe spike made according to the first preferred embodiment of the invention.
Figure 4:
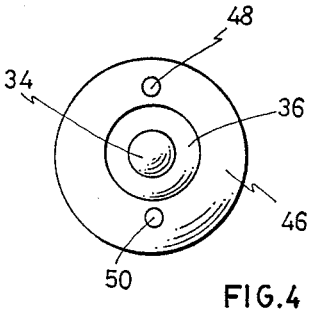
FIG. 4 is a bottom view of the spike of FIG. 3.

As particularly shown in FIGS. 3 and 4, anchor portion 38 is completely embedded in a support member 44 which is preferably made of nylon or plastic, to form a complete spike 28. Support member 44 includes a larger flange portion 46 disposed on the anchor portion side of and against smaller flange portion 36. It has a concave surface, when viewed from the direction of head portion 34, which forms an extension of the concave surface of the smaller flange portion. The larger flange portion extends radially from axis 32 and its outer rim contacts the sole of a shoe to which the spike is attached. Extending into the larger flange portion from the concave surface are a pair of oppositely positioned installation holes 48 and 50 sized to be used with a conventional key or wrench so that the entire spike member may be tightened into or removed from a receptacle.

In order to attach the spike to a receptacle, an engagement portion 52 of support member 44 surrounding the anchor portion and extending along axis 32 beyond the larger flange portion, has external threads 52*a*. Engagement portion 52 thus forms a male part which is matingly received in a correspondingly threaded female receptacle.

During manufacture, support member 44 is directly injected around the anchor portion and against one side of the smaller flange portion of spike member 30. Thus the injected material of which the support member is formed fills grooves 40 and 42. After solidifying, the presence of the material in the grooves prevents the spike member from rotating relative to the support member. It has the further advantage of preventing the removal of the anchor portion from the support member since the counter-rotating grooves act as a block to relative movement in the direction of axis 32. Because of the additional friction between the contacting surfaces of the anchor portion and engagement portion produced by the grooves, it will be seen that either grooves 40 or 42 would be sufficient to effectively prevent relative removal or rotation.

Other preferred embodiments of spike members are shown in FIGS. 5-13. For simplicity of illustration, the support member associated with each of them for a complete spike is not shown. It will be understood, to the extent it is not individually explained, that the anchor portions are fully embedded in the support members which have a larger flange portion and engagement portion which surrounds the anchor portion, similar to that just described with reference to FIGS. 3 and 4. Further, the head and smaller flange portions are substantially identical to portions 34 and 36 of spike member 30. During injection molding, the injected material completely surrounds and fills in any surface irregularities in the anchor portion.

Figure 5:
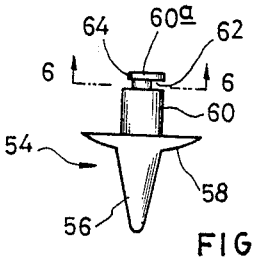
FIGS. 5,7 and 9 are side views similar to FIG. 1 of second, third and fourth preferred embodiments.
Figure 6:
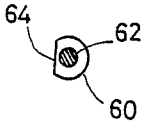
FIGS. 6,8 and 10 are cross sections of the spike members of FIGS. 5,7 and 9, taken along lines 6—6,8—8 and 10—10, respectively.

Referring now to FIGS. 5 and 6, a second preferred embodiment is shown. It includes a spike member 54 having a head portion 56, a smaller flange portion 58, and a generally cylindrical anchor portion 60. Anchor portion 60 has a groove 62 extending continuously around the circumference of the anchor portion. The groove is normal to the longitudinal axis of the anchor portion and is positioned adjacent the distal end of the anchor portion, although it could be positioned anywhere along it. This leaves an end 60*a* which has one circumferential edge 64 flattened.

Groove 62 provides a lip which prevents the removal of the anchor portion from the support member of the spike. Flattened edge 64 provides a structure which is nonsymmetrical with respect to the longitudinal axis of the anchor portion. This prevents relative rotation between the anchor portion and the support member.

Figure 7:
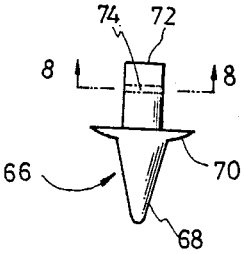
Figure 8:
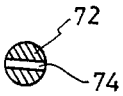

A third preferred embodiment in the form of a spike member 66 is shown in FIGS. 7-8. It has a head portion 68, a smaller flange portion 70, and a generally cylindrical anchor portion 72. Anchor portion 72 has a bore 74 extending laterally through it, although it would be sufficient for it to extend part way into it. This single bore is sufficient to both prevent relative rotation and axial separation of the anchor portion and the support member.

Figure 9:
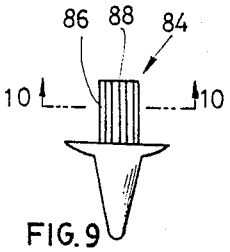
Figure 10:
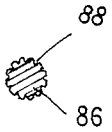

FIGS. 9 and 10 illustrate an embodiment of a spike member 84 characterized by a generally cylindrical anchor portion 86 having a plurality of longitudinally extending grooves 88. These grooves prevent relative rotation between the two spike elements. Each groove adds surface friction between the two members and therefore, particularly when numerous grooves exist, makes separation difficult.

Figure 11:
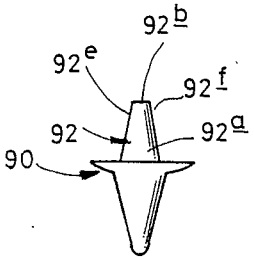
FIG. 11 is a side view of yet a fifth embodiment of a spike member.
Figure 12:
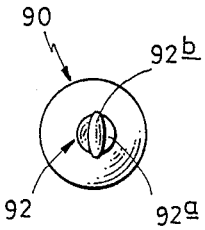
FIG. 12 is a top view of the spike member of FIG. 11.
Figure 13:
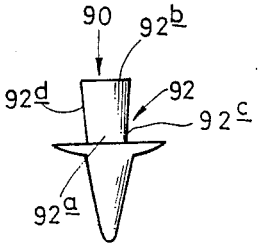
FIG. 13 is another side view of the spike member of FIG. 11 taken from either side of the view of FIG. 11.
Figure 14:
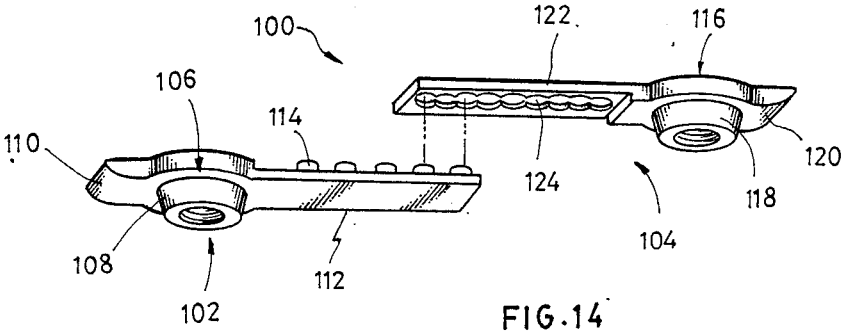
FIG. 14 is a perspective view of the preferred embodiment of the receptacle assembly of the present invention.

The final spike embodiment is illustrated in FIGS. 11-13. A spike member 90 has an anchor portion 92 which is generally circular in cross section at its base 92*a* and then becomes oval in a cross-section normal to a longitudinal axis of said anchor portion at the distal end 92*b* thereof, as shown in FIG. 12. The oval shape is preferably formed by deforming the end of cylindrically shaped anchor portion such as by hammering. The result is that two opposite sides 92*c* and 92*d* diverge, as shown in FIG. 13, and two other opposite sides 92*e* and 92*f* converge, as shown in FIG. 11, from the base to the distal end.

The oval shape prevents the rotation of anchor portion 92 relative to the engagement portion which is injected around it. The diverging sides prevent the metal spike member from pulling out of the engagement portion.

It will be appreciated that each of the spike member embodiments shown define a spike when embedded in a support member which prevents the relative rotation and/or removal of the two parts. The result is an effective spike which is easy to manufacture, durable, and has nylon, plastic or other synthetic threads for use with a receptacle made of similar material.

Referring now generally to FIGS. 14–21, a receptacle assembly 100 made in conformance with the invention is described. Assembly 100 preferably is made of nylon or other material corresponding to the material of the engagement portion of a spike to be used with it. It includes a first receptacle member 102 adjustably connectable to a second receptacle member 104. When connected and placed in the sole of a shoe, the assembly provides a base for spreading the forces produced by spikes attached to them.

Figure 16:
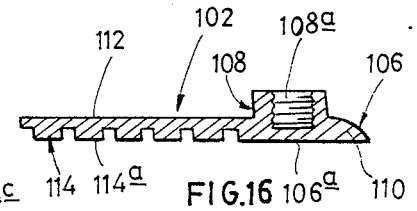
FIG. 16 is a cross section taken along line 16—16 in FIG. 15.
Figure 17:
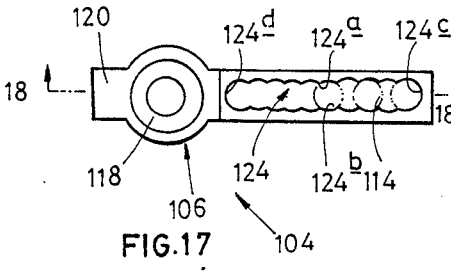
FIG. 17 is a bottom view of the second receptacle member shown in FIG. 14.
Figure 15:
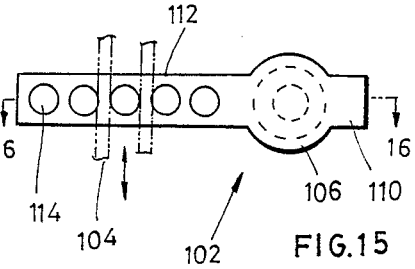
FIG. 15 is a top view of a first of two receptacle members shown in FIG. 14.

FIGS. 15 and 16 show a top view and cross section of member 102. It is elongate and includes a base portion 106 formed in one end. The base portion has a surface 106*a* which is planar. Opposite from surface 106*a* is a protruding receptacle 108 having an inner aperture 108*a* threaded to matingly receive the threads of an engagement member of a spike. Extending radially from receptacle 108 is a support lip 110 which provides a broader base for the receptacle. Extending radially from the receptacle opposite from the lip is a generally planar arm 112. Arm 112 is disposed in a plane parallel with the plane of base surface 106*a*. Arm 112 is solid and has extending from a surface on the same side as surface 106*a* a plurality of knobs 114. These knobs are generally circular in cross section and have ends 114*a* which are flat and coplanar with the plane of base surface 106*a*. The five knobs shown are spaced apart equally by a distance preferably less than the radius of the knobs, for a reason which will become apparent shortly.

Figure 18:
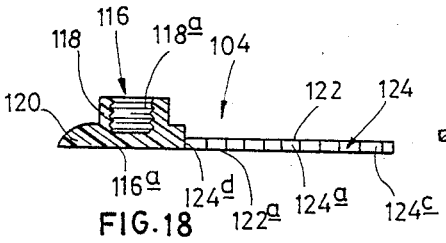
FIG. 18 is a cross section taken along line 18—18 in FIG. 17.
Figure 20:
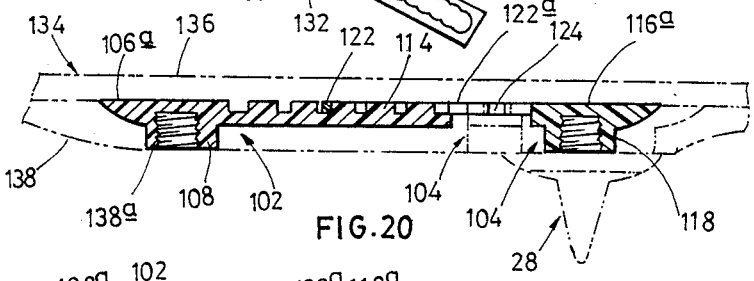
FIG. 20 is a cross section view similar to the combination of FIGS. 16 and 18 showing the first and second receptacle members engaged for placement in a shoe sole.

Receptacle member 104 has a base 116, base surface 116*a*, receptacle 118, threaded bore 118*a*, and lip 120 which are substantially the same as the corresponding features of member 102. However, an arm 122 extending radially from base 116 has an aperture 124 with a serrated-like edge. The serration is formed by a plurality of paired circular arc portions, such as arc portions 24*a* and 124*b*. These arc portions are portions of a circle having a diameter slightly larger than the cross-section diameter of knobs 114. The two end arcs 124*c* and 124*d* are formed as a continuous arc of the same diameter as that associated with the arc portions. The arc portions are selected so that knobs 114 will be received in opposite pairs of arc portions, as is indicated by the phantom lines of knobs 114. As is apparent, the thickness of the distal end of arm 122 is slightly less than the distance between knobs so that the two arms can be connected with only a portion of the knobs received in aperture 124, as shown in FIG. 20. The lower surface of arm 122, as viewed in FIG. 18, is coplanar with base surface 116*a*.

Figure 19:
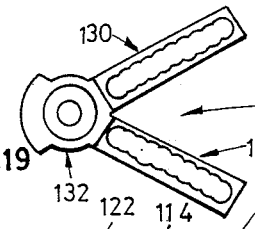
FIG. 19 is a bottom view of an alternative embodiment of the second receptacle member.

An alternative embodiment of receptacle member 104 is shown as receptacle member 126 in FIG. 19. This embodiment is constructed substantially the same as member 104 except that it has two arms 128 and 130 which extend radially from a base portion 132. These arms are structured like arm 122 and extend at an angle relative to each other of approximately sixty degrees. This angle is only significant to the extent it allows for the placement of an arm 102 on each one of them so that the associated receptacles are at desired positions.

It should be noted, as shown by the phantom lines in FIG. 15 of a portion of an arm 104, the two types of arms can be placed transversely of each other with a single knob received in an arc pair in the aperture of the other arm. This, however, is a less stable arrangement than that shown in FIG. 20.

It is also preferable to size the arc pairs in aperture 124 so that a knob 114 may be slid with a slight amount of force along the aperture. This allows the spacing of the respective receptacles after the knobs have been placed in the aperture so long as all of the knobs are disposed in the aperture or, as will be further described, if the distal end of arm 112 is cut off to provide for closer spacing of the respective receptacles. This feature is illustrated by the double-ended arrow shown in phantom in FIG. 15.

FIG. 20 shows assembly 100 with arms 102 and 104 joined and in position for placement in a shoe sole, shown in phantom generally at 134. Sole 134 includes a base sole layer 136 against which the base and coplanar surfaces of the arms seat and to which they are adhered, as by glue. An exposed sole layer 138 has apertures 138*a* sized to receive receptacles 108 and 118 so that the receptacle bores are exposed. Preferably, the rims of the receptacles are flush with, or just recessed from, the exposed surface of layer 138. Layer 138 is also adhered to layer 136 and receptacle assembly 100.

Figure 21:
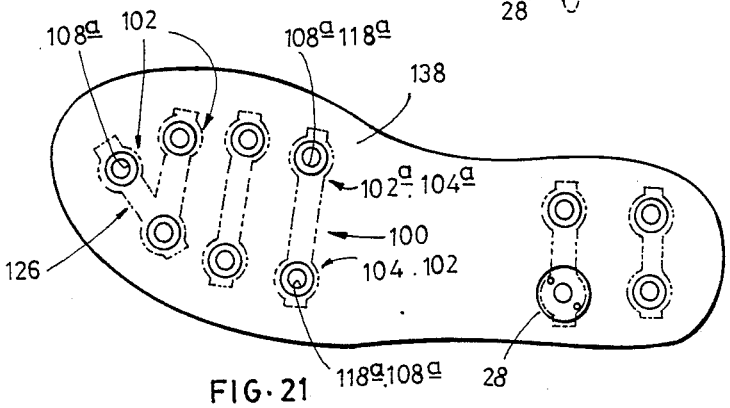
FIG. 21 is a view of the sole of a shoe carrying several receptacle assemblies.

Finally, FIG. 21 shows a view of sole layer 138 from the bottom of FIG. 20. The receptacle rims and bores are exposed. A spike 28 is shown inserted in one of the receptacles. It will be noted that the receptacle assemblies may be assembled to provide different distances between the receptacles. This my be accomplished in two ways. One is to vary the position of the knobs in the arc pairs of the aperture. An intermediate position of this is shown in FIG. 20. This provides for a range of distances defined by the lengths of the respective arms.

If a distance shorter than that available with the preformed lengths is desired, it may be achieved by cutting off the distal ends of the respective arms. So long as at least the end arc and one knob remain on the arms, they can be connected together. This may be necessary to achieve the heel receptacle placement required for a pair of small shoes.

A receptacle assembly as described provides an adjustable arrangement of receptacles in an extended base which provides increased support. Further, the embodiments shown provide for the positioning of receptacles in a variety of locations and arrangements so that shoes of various sizes can all be provided with just the receptacle members shown.

While the invention has been particularly shown and described with reference to the foregoing preferred embodiments, it will be understood by those skilled in the art that other changes in form and detail may be made therein without departing from the spirit and scope of the invention as defined in the claims.

What I claim is:

1. A traction spike for removable attachment to a receptacle in the underside of a shoe sole, comprising:

a metal spike member including a ground-engaging head portion extending along an axis and having a tip disposed along said axis, an anchor portion extending along said axis from said head portion opposite from said tip, and a smaller flange portion extending radially outward from a region between said head portion and said anchor portion;

a unitary support member including a larger flange portion disposed adjacent said smaller flange portion opposite from said head portion extending radially outward further than said smaller flange portion, and an engagement portion having external threads for engagement with an internally threaded socket in a receptacle, said engagement portion being molded about said anchor portion; and means for preventing the removal of said anchor portion from said engagement portion;

wherein said anchor portion has a pair of opposite sides which diverge away from said smaller flange portion in an axially nonsymmetrical fashion.

2. A traction spike for removable attachment to a receptacle in the underside of a shoe sole comprising:

a metal spike member including a ground-engaging head portion extending along an axis and having a tip disposed along said axis, an anchor portion extending along said axis from said head portion opposite from said tip, and a smaller flange portion extending radially outward from a region between said head portion and said anchor portion;

a unitary support member including a larger flange portion disposed adjacent said smaller flange portion opposite from said head portion extending radially outward further than said smaller flange portion, and an engagement portion having external threads for engagement with an internally threaded socket in a receptacle, said anchor portion being embedded in said engagement portion; and means for preventing the removal of said anchor portion from said engagement portion;

wherein said anchor portion is generally circular in cross section along the axis, said means for preventing removal comprising a circumferential groove extending around said anchor portion, and further including a flattened circumferential edge portion formed in said anchor portion at an end thereof opposite said groove from said smaller flange portion for preventing rotation of said support member relative to said spike member.

3. A traction spike for removable attachment to a receptacle in the underside of a shoe sole, comprising:

a metal spike member including a ground-engaging head portion extending along an axis and having a tip disposed along said axis, an anchor portion extending along said axis from said head portion opposite from said tip, and a smaller flange portion extending radially outward from a region between said head portion and said anchor portion;

a unitary support member including a larger flange portion disposed adjacent said smaller flange portion opposite from said head portion extending radially outward further than said smaller flange portion, and an engagement portion having external threads for engagement with an internally threaded socket in a receptacle, said anchor portion being embedded in said engagement portion, means for preventing the removal of said anchor portion from said engagement portion; and means for preventing rotation of said support member relative to said spike member, said preventing means comprising at least a portion of said anchor portion having an elongate cross section normal to the longitudinal axis of said anchor portion;

wherein said anchor portion includes a pair of opposite sides which diverge away from said smaller flange portion in an axially nonsymmetrical fashion.

4. A traction spike for removable attachment to a receptacle in the underside of a shoe sole comprising:

a metal spike member including a ground-engaging head portion extending along an axis and having a tip disposed along said axis, an anchor portion extending along said axis from said head portion opposite from said tip, and a smaller flange portion extending radially outward from a region between said head portion and said anchor portion; and a unitary synthetic support member including a larger flange portion disposed adjacent said smaller flange portion opposite from said head portion extending radially outward further than said smaller flange portion, and an engagement portion having external threads for engagement with an internally threaded socket in a receptacle, said anchor portion being embedded in said engagement portion; and means for preventing the rotation of said support member relative to said spike member;

wherein said anchor portion is generally circular in cross section along the axis, said means for preventing removal comprising a circumferential groove extending around said anchor portion, and further including a flattened circumferential edge portion formed in said anchor portion at an end thereof opposite said groove from said smaller flange portion for preventing removal of said anchor portion relative to said engagement portion.

5. A traction spike for removable attachment to a receptacle in the underside of a shoe sole, comprising:

a metal spike member including a ground-engaging head portion extending along an axis and having a tip disposed along said axis, an anchor portion extending along said axis from said head portion opposite from said tip, and a smaller flange portion extending radially outward from a region between said head portion and said anchor portion; and a unitary synthetic support member including a larger flange portion disposed adjacent said smaller flange portion opposite from said head portion extending radially outward further than said smaller flange portion, and an engagement portion having external threads for engagement with an internally threaded socket in a receptacle, said engagement portion being molded about said anchor portion; and means for preventing the rotation of said support member relative to said spike member;

wherein said means for preventing rotation comprises at least a portion of said anchor portion having an elongate cross section normal to the longitudinal axis of said anchor portion, and wherein said anchor portion includes a pair of opposite sides which diverge away from said smaller flange portion in an axially nonsymmetrical fashion.

* * * * *